US006487822B1

(12) United States Patent
Haack et al.

(10) Patent No.: US 6,487,822 B1
(45) Date of Patent: Dec. 3, 2002

(54) CEILING ELEMENT FOR A COMPOSITE CEILING

(76) Inventors: Jörg Haack, Ehlenstrasse 14, D-50389 Wesseling (DE); Andreas Gradinger, Am Knupp 14, D-51515 Kürten (DE)

( * ) Notice: Subject to any disclaimer, the term of this patent is extended or adjusted under 35 U.S.C. 154(b) by 0 days.

(21) Appl. No.: 09/719,590

(22) PCT Filed: Jun. 11, 1999

(86) PCT No.: PCT/EP99/04021

§ 371 (c)(1),
(2), (4) Date: Dec. 12, 2000

(87) PCT Pub. No.: WO99/66146

PCT Pub. Date: Dec. 23, 1999

(30) Foreign Application Priority Data

Jun. 12, 1998 (DE) ..... 198 26 149

(51) Int. Cl.[7] ..... E04B 9/04; E04B 1/86

(52) U.S. Cl. ..... 52/144; 52/145; 52/506.09; 52/794.1; 181/290; 181/292

(58) Field of Search ..... 52/792.1, 794.1, 52/799.1, 144, 145, 506.07, 506.09; 181/290, 292

(56) References Cited

U.S. PATENT DOCUMENTS

| | | | | | |
|---|---|---|---|---|---|
| 2,271,929 | A | * | 2/1942 | Venzie | 52/145 |
| 2,913,075 | A | * | 11/1959 | Zittle | 181/290 X |
| 3,007,539 | A | * | 11/1961 | Brewer et al. | 52/144 |
| 3,095,943 | A | * | 7/1963 | Kemp | 181/292 |
| 3,437,457 | A | * | 4/1969 | Fisher | 428/605 |
| 3,452,496 | A | * | 7/1969 | Thompson | 52/145 |
| 3,900,997 | A | * | 8/1975 | Ollinger et al. | 52/506.07 |
| 4,428,454 | A | * | 1/1984 | Capaul et al. | 181/290 |
| 5,001,883 | A | * | 3/1991 | Landheer | 52/794.1 |
| 5,192,624 | A | * | 3/1993 | Morimoto | 181/290 X |
| 6,029,770 | A | * | 2/2000 | Schneider et al. | 181/290 X |

FOREIGN PATENT DOCUMENTS

| | | | |
|---|---|---|---|
| AT | 206159 | * 11/1959 | 52/506.07 |
| DE | 3514267 | 10/1986 | |
| DE | 4430292 | 2/1996 | |
| EP | 0085863 | 8/1983 | |
| EP | 0361727 | 4/1990 | |
| EP | 0664365 | 7/1995 | |
| GB | 663897 | * 12/1951 | 181/292 |

* cited by examiner

*Primary Examiner*—Laura A. Callo
(74) *Attorney, Agent, or Firm*—Martin A. Farber

(57) ABSTRACT

A invention relates to a ceiling element (1) for a ceiling (D) consisting of several ceiling elements, comprising a lower metal support (4) which is divided up by links (7) and has holes; and an active sound layer (5) which is arranged in the metal support. The layer is a sound insulation layer or a sound absorption layer for example, especially in the form of an open-pore foam such as a melamine-resin foam. The active sound layer (5) is bonded to the metal support (4). According to the invention, the adhesive (6) is only applied to the link areas (11) and only the inner surfaces of the link areas (11) are bonded. This guarantees a simple, economical construction.

27 Claims, 6 Drawing Sheets

CEILING ELEMENT FOR A COMPOSITE CEILING

FIELD AND BACKGROUND OF THE INVENTION

The invention relates to a ceiling element for a ceiling composed-of a plurality of ceiling elements, having a lower metal support, which has apertures separated by webs, and an active sound layer, such as a sound insulation layer or sound absorption layer accommodated in the metal support, the layer being in particular in the form of an open-pore foam, for example, a melamine resin foam, the active sound layer being bonded to the metal support.

A very wide variety of configurations of ceiling elements of this type are known. They are used in a ceiling-forming manner so as to provide a "suspended ceiling" in a building below an intermediate floor. The gap between intermediate floor and suspended ceiling can be used in advantageous manner for concealed routing of supply lines. The suspended ceiling generally also supports functional elements, such as lights, loudspeakers and sound insulation features. Reference should be made in this regard to DE 44 30 292 A1.

The active sound layer can be connected to the metal support by an adhesive layer, serving as a bonding agent, on the sound insulation layer or sound absorption layer. The conventional, detachable protective covering is generally also needed here. The corresponding complete installation is costly.

SUMMARY OF THE INVENTION

It is an object of the invention to provide a configuration which is structurally simple and is more favorable economically.

This object is first and foremost achieved in a ceiling element having the introductory-mentioned features wherein the adhesive is only applied to the web regions, and the bonding is only carried out on the inner surfaces of the web regions. The apertures in the metal support are kept free of adhesive. It is therefore not possible for any airborne particles to adhere here. The proportion of the surface area used for securing the metal support to the active sound layer can be strictly minimized, but nevertheless provides a good load-bearing bond. Even portions of adhesive spreading somewhat over the border of the webs or web regions are negligible; they do not constitute any significant reduction in the opening of the apertures. Said apertures are dimensioned in such a manner that an adhesive membrane does not arise. Provision is furthermore made for the bonding to be strengthened at web intersections. In the case of lattice-like network structures, these are the "intersecting points". The latter generally turn out to be somewhat larger in terms of surface area. This results in correspondingly larger bonding surfaces for the adhesive. Whereas when a lower metal support is used, the active sound layer can only be seen within the framework of the apertures, a solution may also be resorted to the effect that an upper metal support is provided, and that the active sound layer is bonded thereto. The metal support is therefore situated more closely to the intermediate floor than the active sound layer which it carries on its lower side. As regards the bonding, the same advantages are present if the upper metal support has apertures separated by webs and the bonding is only carried out in the region of the webs. It is expedient for the upper and lower metal supports to consist of expanded metal. Under some circumstances, the expanded metal may have a different fine-meshed structure. A solution is even conceivable to the effect that two metal supports are used for one ceiling element. The procedure here is for the lower metal support and the upper metal support to be connected only by means of the active sound layer. The latter acts as a retaining bridge. Moreover, it is favorable for the lower metal support and the upper metal support also to have, in comparison with the extent of the surface, an angled border region running at an angle of 30 to 45° with respect to said surface extent. This gives a type of shell-like border. At the same time, appropriate deep-drawing increases the surface stability of the ceiling element. Provision is then made for the angled portion of the angled border region to run toward the active sound layer. It has proven favorable, both in terms of reinforcing and with regard to exact fitting of the ceiling element into a support structure, for the angled border region to merge at its border edge into a flattened portion. This lies parallel in space to the dominant, remaining surface extent. In order also to ensure the same insulation or absorption effect right to the periphery of the ceiling elements, it is further provided for the active sound layer to be carried through in a continuous manner into the angled border region. In order, even in the angled border region, to obtain a contour-corresponding profile for the active sound layer, it is furthermore proposed for the angled border region to be formed after the active sound layer is bonded to the metal support.

On a ceiling element for a ceiling composed of a plurality of ceiling elements, having a lower metal support, which has apertures separated by webs, and an active surface layer, such as a sound insulation layer or sound absorption layer, incorporated in the metal support, an advantageous configuration is obtained by means of an upper metal support. This produces a solution which is particularly suitable for load-supporting and can cover large surface areas. Provision is also made here for the upper metal support to have apertures separated by webs. A particularly stable solution is provided if the upper metal support is connected at its border to the lower metal support. A hinged or folding-box-like "cage" for the active sound layer may even be obtained if the connection is hinge-like at one border region and is positively-locking at the opposite side. Positive-locking goes as far as including in its meaning a latching connection. The advantage of this solution also resides in the possibility of fitting anew or refitting the layer of this ceiling element. If such a more elaborate implementation is not desired, it is also sufficient for the upper metal support and the lower metal support to be connected in a simple manner, for example in a material-combining manner. Welding, e.g. spot welding, is meant here. Even soldering may be used as a connecting means. With regard to the upper metal support, the special configuration which has already been explained may be selected by the upper metal support also consisting of expanded metal. The further configuration of the upper metal support having protruding fixing sections has proven advantageous in mounting terms with regard to the ceiling elements. Fixing sections of this type are formed integrally on opposite border regions. Attention is paid here to being able to release ceiling elements in a manner which does not affect the surrounding area, i.e. the other ceiling elements, in terms of position. In detail, measures of this type reside in the fact that one fixing section is formed in a vertical projection with the lower metal support. The lower metal support therefore conceals the retaining means from sight. Provision is furthermore made on the mutually opposite border regions for fixing sections to be formed in a vertical projection within, on the one hand, and outside, on the other hand, the lower metal support. Specifically, provision for this is made in such a manner that the offset dimension of the one fixing section corresponds to the projecting dimension of the other fixing section of the adjacent ceiling element. The measure that when there is a vertical projection within the lower metal support below the fixing sections, a lifting clearance for angling out a ceiling element from the ceiling is formed, has proven to facilitate the release of the ceiling element. The lifting clearance serving for the corresponding manoeuvering has adequate dimensions, if, in the vertical direction, it corresponds approximately to half the thickness dimension of an active sound layer. Finally, provision is also made for the fixing sections to be strengthened by being double-layered. In this case, there is a simple means to hand using the technical basic concept in that the double-layered state is obtained by folding the border under. The upper metal support has the sufficient plastic deformability necessary for this. This enables the cut border edge of the expanded metal to disappear. The risk of injury in this regard is thereby minimized.

BRIEF DESCRIPTION OF THE DRAWINGS

The subject-matter of the invention is explained in greater detail below with reference to two exemplary embodiments illustrated with the figures of the drawings. In the drawings:

FIG. 7 shows the components of the ceiling element according to a second exemplary embodiment, in an exploded illustration, consisting, starting from the top, of an upper metal support, an active sound layer and a lower metal support.

DETAILED DESCRIPTION OF THE PREFERRED EMBODIMENTS

Figure 1:
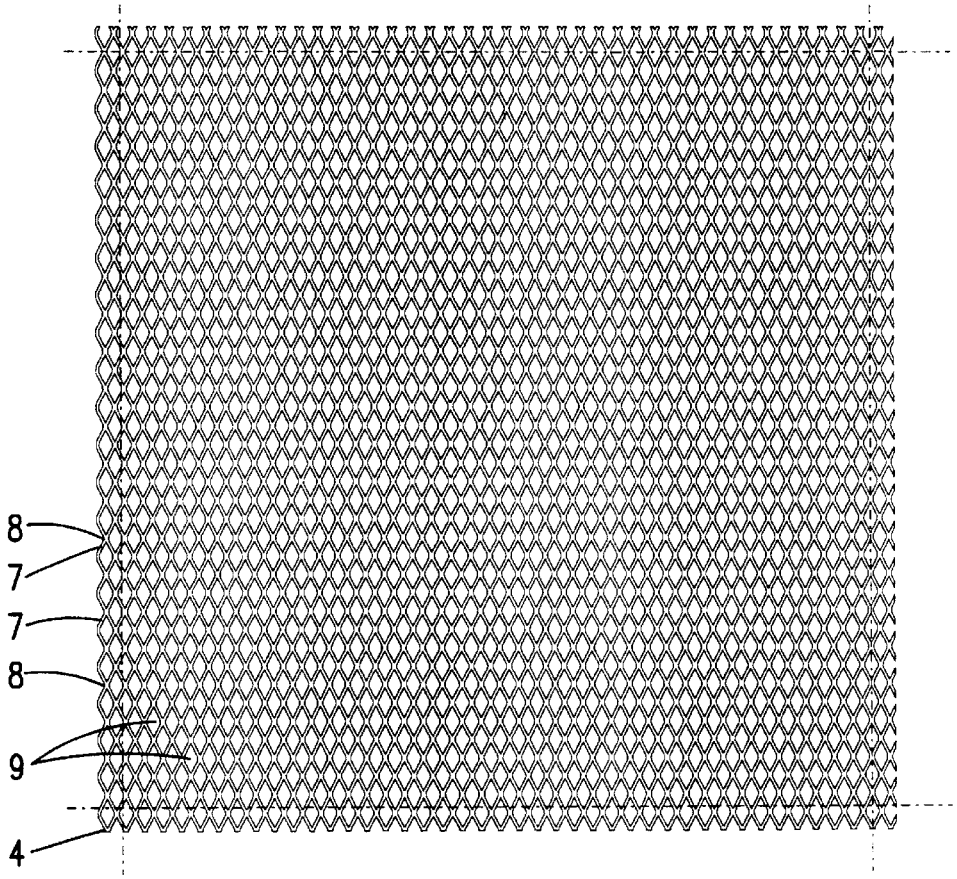
FIG. 1 shows a metal support in plan view.
Figure 2:
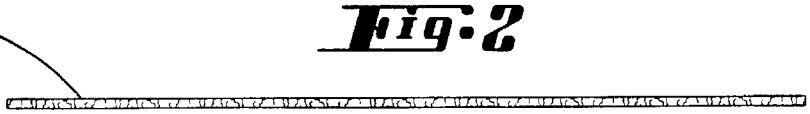
FIG. 2 shows an active sound layer in side view.

The ceiling, denoted in its entirety by D, of a ceiling system comprises a plurality of ceiling elements 1 of identical configuration.

The ceiling D acts in front of an intermediate floor as a suspended false ceiling running parallel thereto.

Supporting rails 2 aligned on the bottom side emerge from the intermediate floor (not illustrated). Said supporting rails are, at least on the bottom side, realized as a T-profile.

The vertical direction of the ceiling intermediate space is penetrated by the T-web of the profile. The T-limbs extend in the horizontal direction protruding on both sides. Their upper side is used as a support shoulder 3 for the ceiling elements 1.

According to a first exemplary embodiment, the ceiling element 1 consists of a lower metal support 4. An active sound layer 5 runs above it.

The lower metal support 4 is perforated to a substantial extent.

Metal support 4 and active sound layer 5 are of approximately the same surface area, a square layout being basically selected. Established sizes are in question. With regard to the active sound layer 5, this is a sound insulation layer or a sound absorption layer, in particular in the form of an open-pore foam material. For example, or preferably, a melamine resin foam is used.

The active sound layer 5 is connected to the metal support 4. There is bonding in the region of contact between the metal support 4 and layer 5. The corresponding adhesive 6 can be seen from FIGS. 5 and 6 as a layer illustrated in an exaggerated manner, made clearer by a dot matrix.

The adhesive 6 is only present on webs 7 and web intersections 8 of the latticework illustrated in FIG. 1. The apertures 9 of the latticework, respectively of the metal support 4, which are separated by webs 7 of this type, are not filled by adhesive 6. Window-like apertures of this type can be produced by punching. However, a metal support 4 realized from a section of flat expanded metal is preferred. FIG. 1 shows the expanded metal structure selected. In this case, the apertures 9 are rhombic-shaped. Their acute-angled inner corners merge onto the abovementioned web intersections 8. In the situation illustrated in FIG. 1, said intersections are of wider dimensions in the horizontal than the cross section of a web 7, as measured over the shortest lateral distance. Accordingly, the bonding at intersections 8 is strengthened. This is also assisted by a channel 10 which can be produced from the expanded metal structure and runs in the direction of the acute-angled inner corners of the apertures 9. As can be seen, the adhesive 6 is accommodated here in a partially thicker layer. A type of nest for adhesive is provided.

The attaching means therefore likewise realized as an adhesive lattice configured congruently to the latticework of 4 keeps the visible surface 12 lying outside the inner surfaces of the web regions 11 free of adhesive.

The area of the apertures 9 is selected in such a manner that closing films are not able to occur (comparable to the membrane-closed ring of a soap bubble device). The adhesive layer nevertheless drawn continuing in the region of the apertures 9 in the enlargements of FIGS. 5 and 6 only shows the narrow edges of this layer. The visible surface 12 is exposed and sound-active. Even portions of adhesive 6 which run onto the end edges 13 of the flat webs 7 do not produce any clogging of the sal ammoniac pastille-shaped aperture 9.

In a reversal of the conditions described with regard to metal support 4 and active-sound layer 5, an upper metal support 4 may alternatively be provided (not illustrated). The active sound layer 5 is bonded thereto in an identical manner. The adhesive action of the adhesive 6 is sufficient to retain the active sound layer 5 which is then located entirely on the visible side and is now suspended. Said layer is relatively lightweight and is suspended, gripped via the adhesive 6 of the upper metal support 4, on the lower side of this latticework.

This upper metal support 4, like the lower metal support 4 illustrated in FIG. 1, also has apertures 9 divided by webs 7, the bonding only being carried out in the region of the webs 7 and, of course, also of the web intersections 8 in this case too.

In addition, when the lower metal support 4 and upper metal support 4 are formed from expanded metal, there is the choice with respect to the fine-meshed structure of the expanded metal. Aluminum is used, for example.

A further alternative is to reinforce both wide sides of the active sound layer 5 with metal supports 4 of the type described. In this case, the lower metal support 4 and the upper metal support 4 are only connected by means of the active sound layer 5, via a layer of adhesive 6 in each case. The foam structure of the layer 5 has the layer strength sufficient for this purpose. Moreover, the lower metal support 4 is capable of vibrating within limits.

Figure 4:
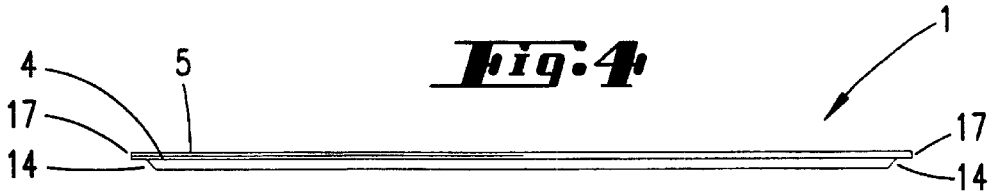
FIG. 4 shows the metal support and layer connected to form a ceiling element, in side view, embodying the first exemplary embodiment.

As can be gathered from FIG. 4, the lower metal support 4 is angled peripherally in the direction of the intermediate floor. An angled portion of this type results virtually in an S-shaped border profile, designated as angled border region 14. This is realized circumferentially. That flank 15 of the border region 14 which correspondingly rises outward encloses an angle of 30 to 45° with respect to the general horizontal plane of extent of the ceiling element 1. Opposite flanks 15 diverge toward said intermediate floor.

The same conditions would prevail if the metal support 4 were situated only at the top.

This also applies to the version which uses two metal supports 4 connected via the interposed, active sound layer 5.

It is then a characteristic of the basic version and also of the two variants that the angled portion of the angled border region 14 runs toward the active sound layer 5 in each case, although in the opposite direction in the case of the upper metal support 4.

A development has been undertaken or can be undertaken both in the basic version and also in the two variants, said development residing in the fact that the angled border region 14 merges at its border edge into a flattened portion 16. This substantially corresponds to the length of the flank 15 and extends parallel in space with respect to the remaining, planar surface region of the ceiling element 1. The angled border edge region 14 is indicated in FIG. 1 by dash-dotted lines.

Figure 5:
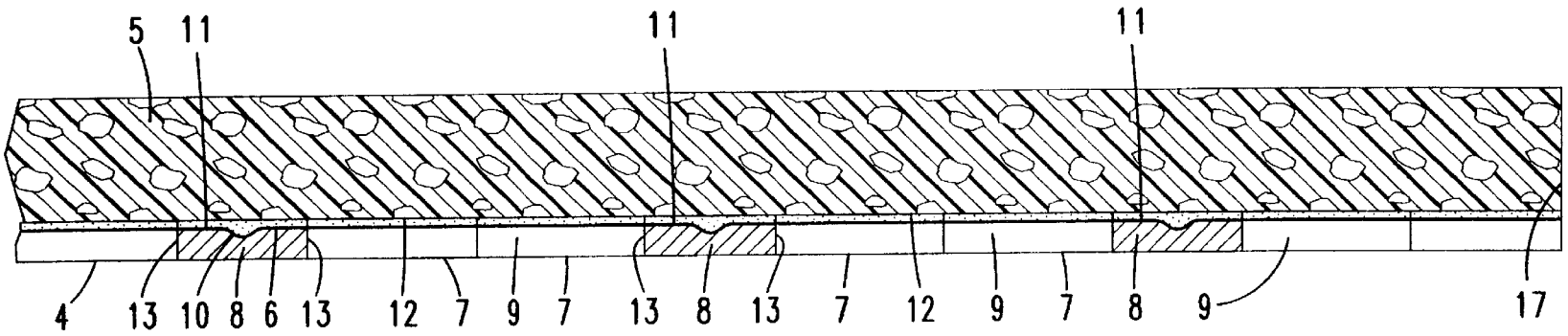
FIG. 5 shows a section through this ceiling element, on a greatly enlarged scale, and not yet deformed at the border.
Figure 6:
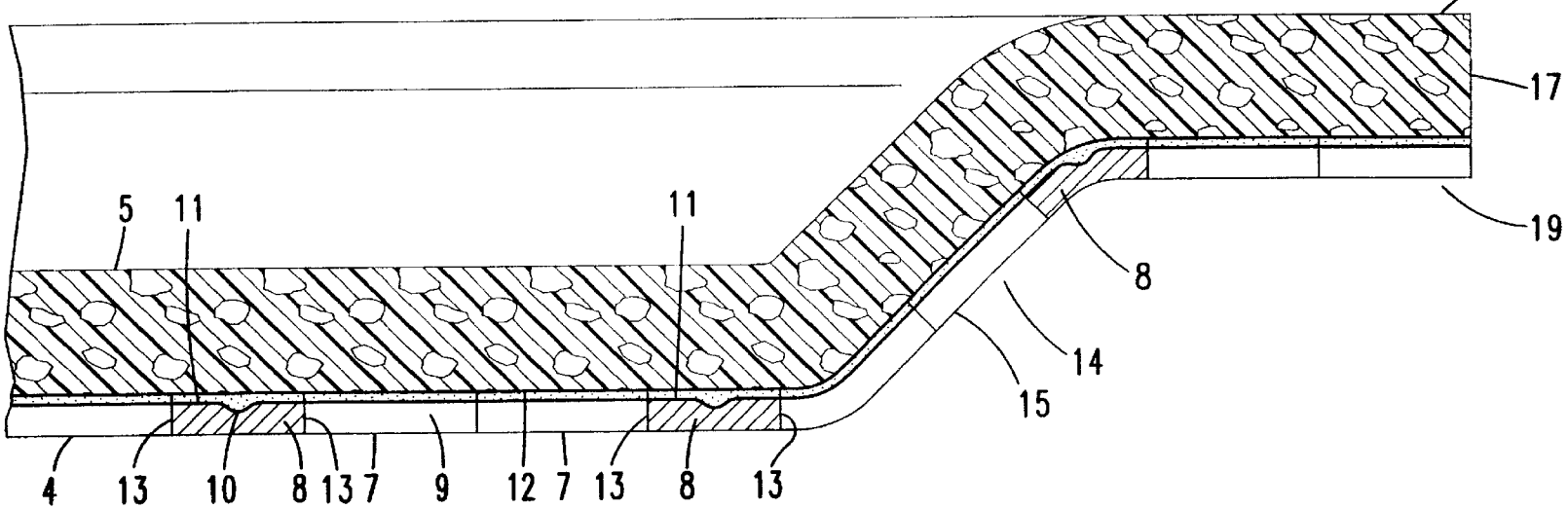
FIG. 6 shows a section which is exactly the same, but now deformed at the border in the region of the periphery of the ceiling element.
Figure 4:
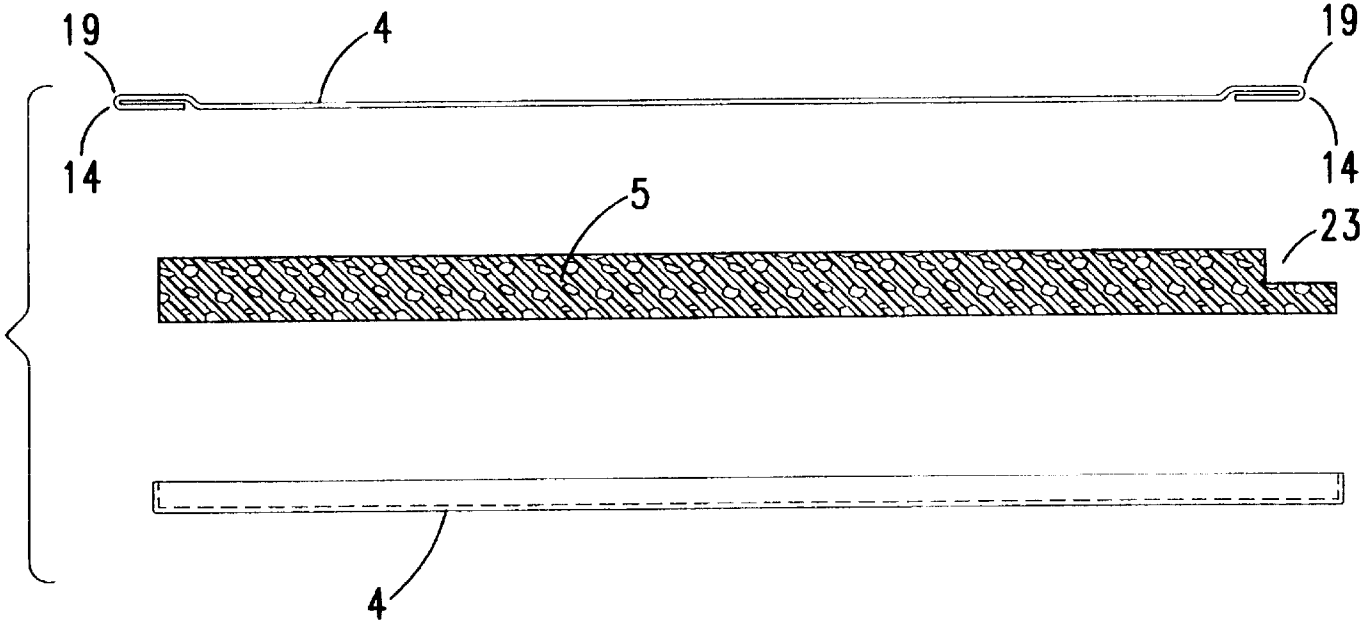
Figure 8:
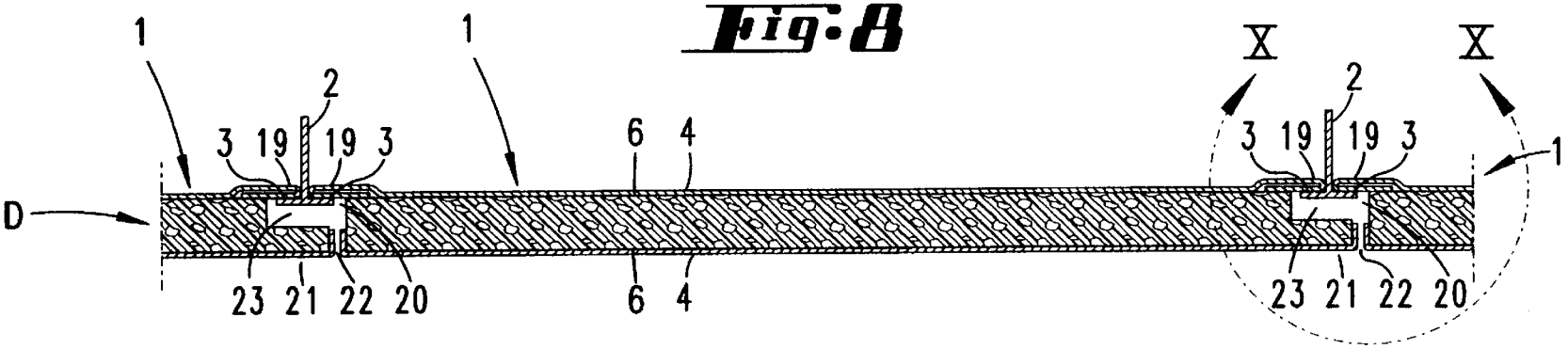
FIG. 8 shows a vertical section through a region of a ceiling, formed by the ceiling elements according to a second exemplary embodiment.

As can be further gathered from FIGS. 5 and 6, the active sound layer 5 is carried continuously through until it reaches the angled region 14, specifically running as far as the border edge 17 of the ceiling element 1. The adhesive 6 also extends through as far as this point. The layers are therefore held fixedly together right into the periphery.

FIG. 5 shows a border portion of the ceiling element 1 before the formation of the angled border region 14, FIG. 6 shows the same embodiment after deep-drawing. The flattened portion 16 can serve as a fixing section with respect to the support shoulder 3.

Figure 3:
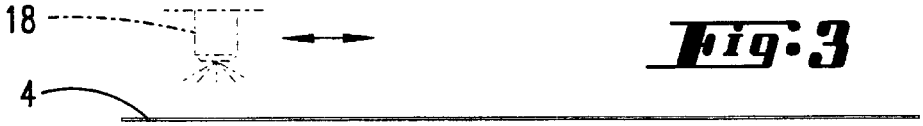
FIG. 3 shows the metal support in side view.

The adhesive 6 can be applied, for example, by the spraying device 18 indicated in FIG. 3. A layer-forming spraying is not needed at all here. It is sufficient if the web regions 11 which face the spraying device 18 receive individual specks of adhesive. Also, for example when the spraying device 18 is guided in a meandering manner, portions can be missed out, with the result that only an adhesive matrix resembling hachuring is present.

Turning now to the subject-matter of the second exemplary embodiment: this ceiling element 1, which is illustrated in FIGS. 7 to 12 and can also be related to the conceptual interpretation of the first exemplary embodiment, for a ceiling D composed of a plurality of ceiling elements 1 likewise comprises a lower metal support 4 having apertures 9 separated by webs 7. Said metal support accommodates an active sound layer 5 cut to size. An upper metal support 4 (which is now illustrated) is associated with this ceiling element 1.

As regards the active sound layer 5, this is also a sound insulation layer or sound absorption layer here. This upper metal support 4 may, as illustrated in FIG. 1, have apertures 9 separated by webs 7 and therefore also has web intersections 8.

The two-layered structure, forming a hinged box, of this ceiling element 1 provides a configuration in which the upper metal support 4 is connected at its border to the lower metal support 4. The active sound layer 5 is encapsulated between the two parts in, as it were, a sandwich-like manner. In the case of a desired irreversible formation, the border connection may be realized by an edge connection, i.e. the borders of both metal supports 4 are formed such that they overlap one another. There can be a double fold here or else a simple overlap of the one metal support 4 over the border of the other.

A reversible, hinged-box-like configuration of the ceiling element 1 can equally well also be achieved. For this purpose, provision is then made for the connection to be hinge-like at one border region and to be positively-locking at the opposite side. The upper metal support 4 then constitutes the cover and the lower metal support 4, which is realized as a shell, constitutes the case of a hinged box of this type. The case-like configuration also emerges from the illustration in the drawing, an illustration of the elements involved in the hinge and closing techniques being omitted, since it can easily be imagined. The mutually opposite border edges 17 may be regarded as the border regions.

A further method which can be used economically for the non-re-openable structure of the ceiling element 1 can involve connecting the upper metal support 4 and the lower metal support 4 in a material-combining manner, i.e. fixing them to one another by welding.

As already indicated, the ceiling elements 1 can be fitted at their borders into the supporting structure of the suspended ceiling.

For this purpose, the procedure in detail is as follows: in both exemplary embodiments, fixing sections 19 are associated with the ceiling elements 1. The first exemplary embodiment, as already indicated, in physical terms involves the protruding flattened portion 16 of the periphery of the ceiling element 1. In the case of a ceiling element 1 having a square layout, there are possibilities for the placement to be optionally turned through 90°.

Figure 10:
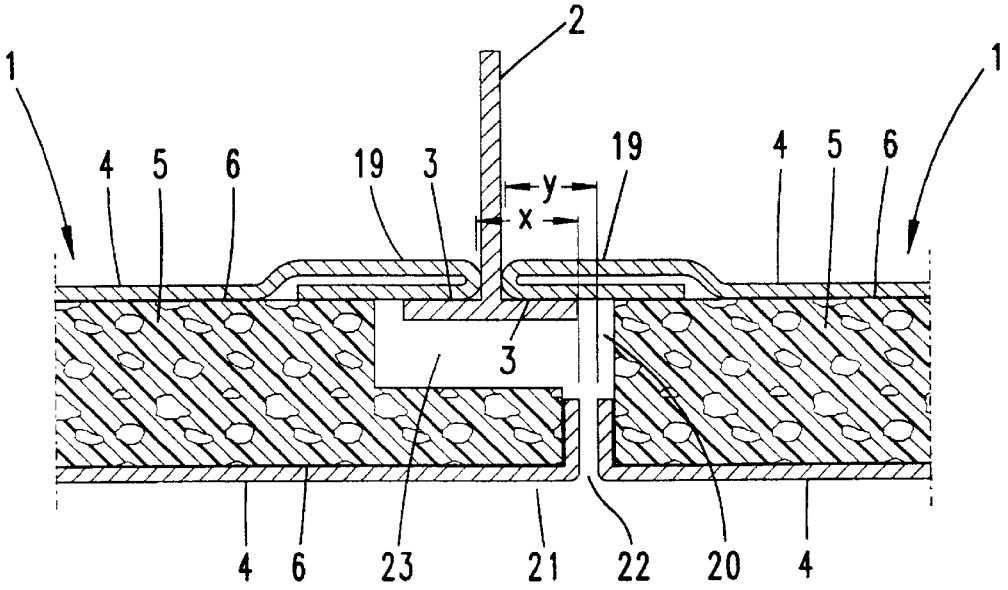
FIG. 10 shows a detail enlargement X from FIG. 8.

In contrast, in the subject-matter of the second exemplary embodiment, the fixing sections 19 are realized on opposite border regions 14. They run parallel and are formed integrally. This is preferably obtained in the circumstances by deformation. Therefore, in the second exemplary embodiment, a double-layered structure is used as regards the fixing sections 19. This stabilizes the fixing section 19. The double-layered structure is obtained in a technically simple manner by folding the border under. As a result, the border regions, which may have burrs, of the metal support 4 also disappear into a concealed zone between a lower side of the upper metal support 4 and the upper side of the active sound layer 5 lying beneath it. Reference should be made to FIG. 10. So that the underside is continuously in the same plane with regard to the upper metal support 4, the border region lying on the upper side of the tucked-under tab is offset upward by the extent of a thickness of the wall.

In a reciprocal manner, one fixing section 19 is formed in a vertical projection with the lower metal support 4 and the opposite fixing section 19 is formed outside the vertical projection of the lower metal support 4. This emerges particularly clearly from FIG. 9. An empty groove 20 remains below the fixing section 19 on the left there. This permits the fixing section 19, which is therefore formed so that it protrudes, to be engaged against the corresponding support shoulder 3 on the right of the supporting rail 2.

Figure 9:
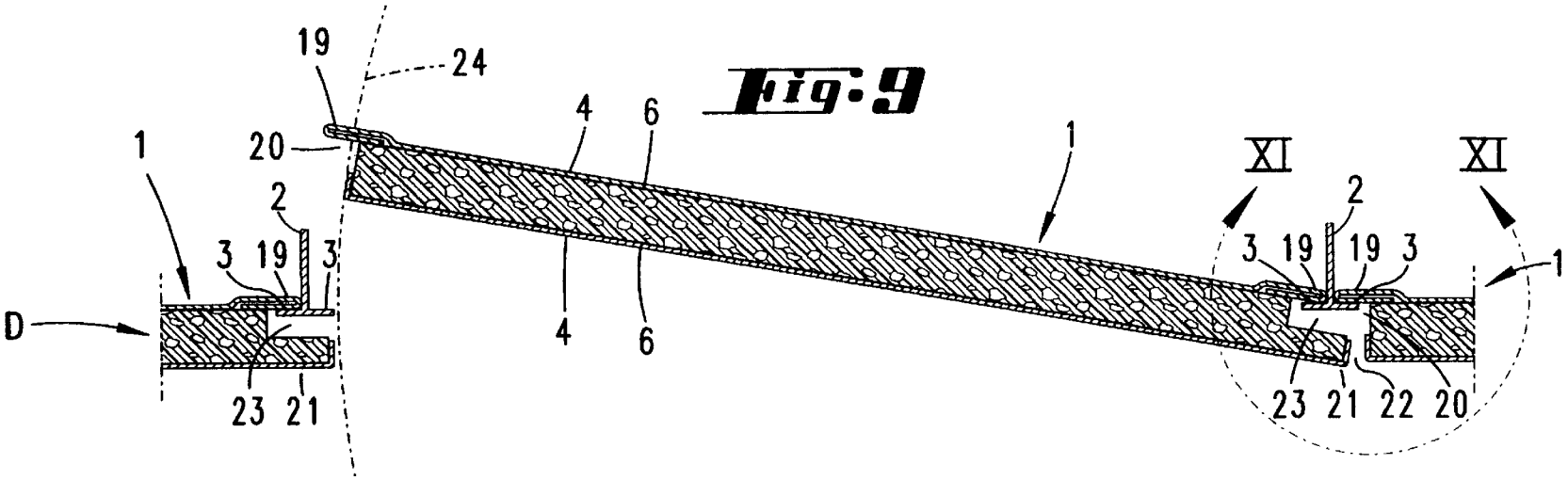
FIG. 9 shows the angling out of a ceiling element from the ceiling.

This border-overlapping, free-standing position of the fixing section 19 with regard to the lower metal support 4 is not present in said FIG. 9. Rather, said fixing section clearly springs back with respect to the border edge of the ceiling element 1 in question. As can be seen, the lower metal support 4 continues over the end of the fixing section 19 on the right. The excess length in this regard is such that the supporting rail 2 is concealed from view. For this purpose, that section of the active sound layer 5 which is on the right and lies in the projection of the fixing section 19 at this point, and of the section, which supports it, of the lower metal support 4 grips as a covering strip 21 under that limb of the T-profile of the supporting rail 2 which forms the support shoulders 3. In this case, the gap 22, which can be seen in FIG. 8, lies toward the right offset laterally from the plane of the web of the supporting rail 2. The covering strip 21 in each case fills the empty groove 20 of the adjacent ceiling element 1, blocking the view at least from below. The gap 22 lies in each case laterally and recessed with respect to the limb end, which is on the right in the drawing, of the supporting rail 2.

As can be seen, a configuration is selected in this case in such a manner (cf. FIG. 10) that the offset dimension x of the one fixing section 19 corresponds to the projecting dimension y of the other fixing section 19, taking into account a mutual spacing to accommodate the vertical web of the supporting rail 2. The spacing may be somewhat larger than illustrated.

Figure 11:
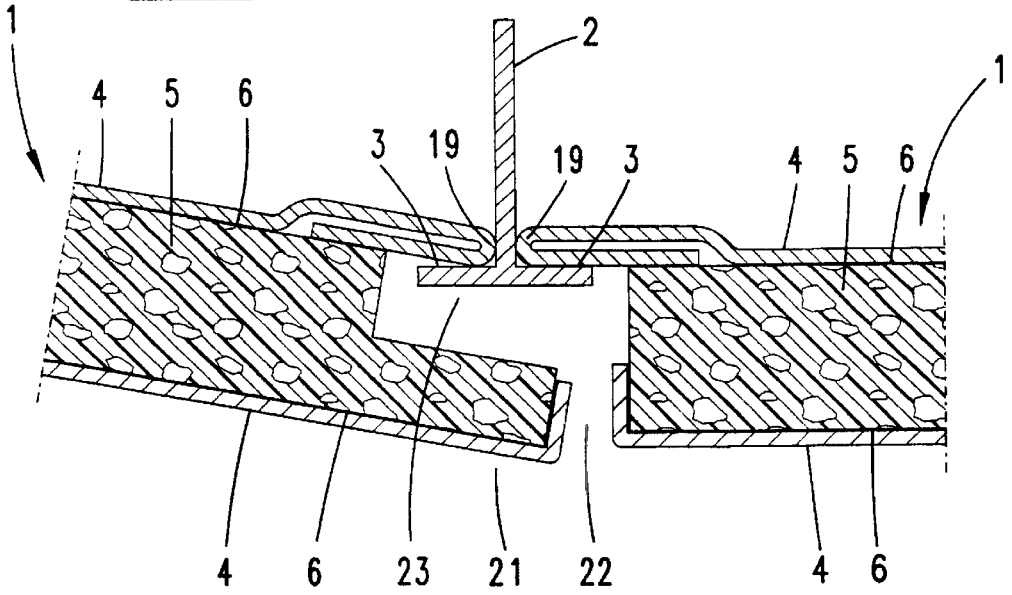
FIG. 11 shows a corresponding detail enlargement XI from FIG. 9.
Figure 12:
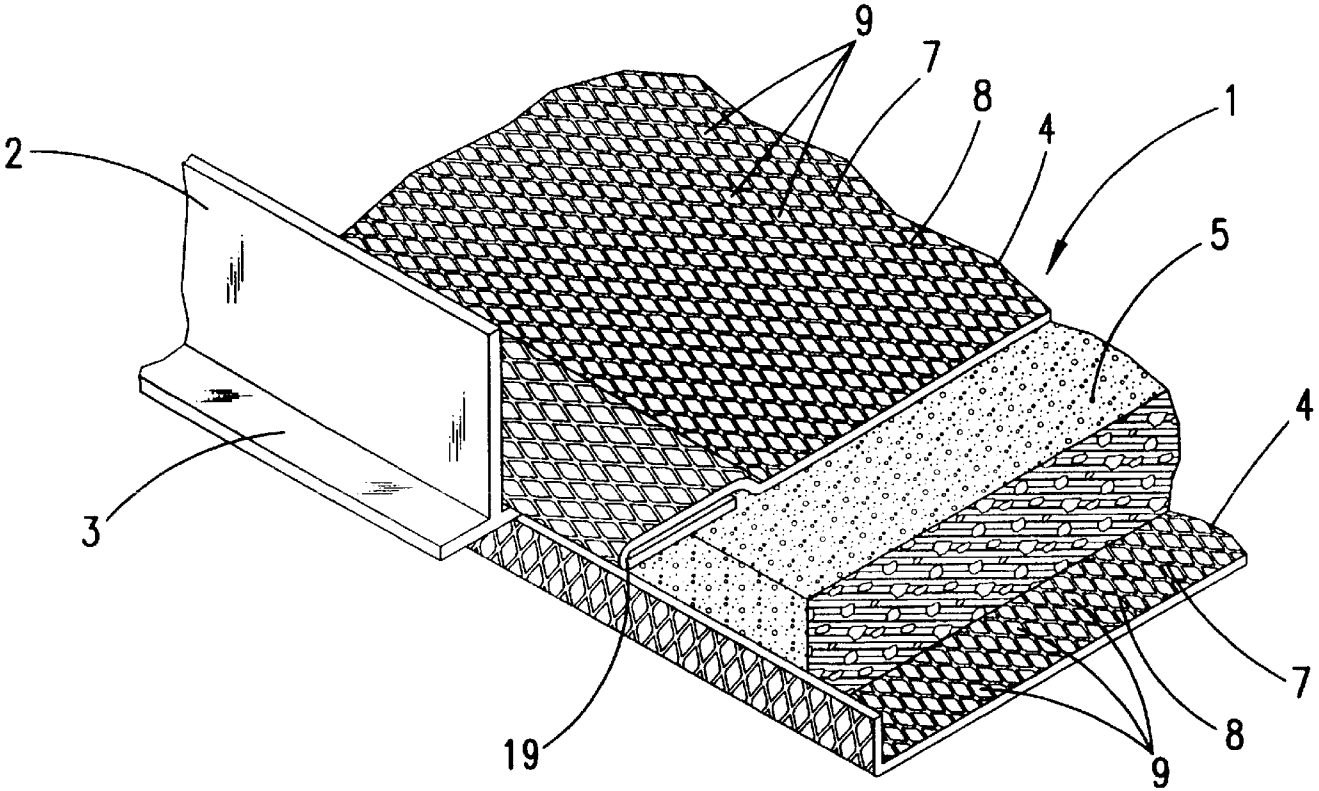
FIG. 12 shows a perspective block representation of a ceiling element, exposed in a staggered manner, together with a supporting rail.

In the region of the two horizontal limbs, forming the support shoulders 3, of the supporting rail 2, the active sound layer 5 is partially removed on the underside for insertion of said limbs. However, the depth is greater than the thickness of the limbs. A lifting-out clearance 23 is therefore produced when there is a vertical projection within the lower metal support 4 below the fixing sections 19. Said clearance provides play which is sufficiently pivot-bearing-forming to enable the operationally correct angling out of a ceiling element 1 from the ceiling D, which is illustrated in FIGS. 9 and 11. There is fully sufficient play if the lifting clearance 23 in the vertical direction corresponds approximately to half the thickness dimension of an active sound layer 5 (taking the approximately realistic thickness ratios illustrated in the drawing as the basis).

The inner groove on the left between support shoulder 3 and vertical web of the supporting rail 2 forms the bearing for the tilting movement. The tilting is facilitated by the transverse rounding of the end of the fixing section 19 as a consequence of the described folding-under of the border.

The bonding described may likewise apply as far as the ceiling element 1 is concerned. The fact that the adhesive 6 does not clog the apertures and also the manner of coating in this regard, that the adhesive bond is produced just by strips or islands, also holds true here.

Because the tilting point lies at the top, the angling out with regard to the following ceiling element on the left takes place in an interference—i.e. contact-free manner, as the pivoting arc 24 drawn in FIG. 9 shows.

We claim:

1. A ceiling element (1) for a ceiling (D) comprising a plurality of ceiling elements, having a lower metal support (4), which has apertures separated by webs (7), and an active sound insulation layer (5) accommodated in the metal support (4), and the active sound insulation layer (5) being bonded to the metal support (4), wherein adhesive (6) is only applied to web regions (11), the bonding is only carried out on inner surfaces of the web regions (11), and the bonding is strengthened at web intersections.

2. A ceiling element according to claim 1, wherein an upper metal support (4) is provided, and the active sound layer (5) is bonded thereto.

3. A ceiling element according to claim 1, wherein the sound layer comprises open-pore foam.

4. A ceiling element (1) for a ceiling (D) comprising a plurality of ceiling elements, having a lower metal support (4), which has apertures separated by webs (7), and an active sound insulation layer (5) accommodated in the metal support (4), and the active sound insulation layer (5) being bonded to the metal support (4), wherein adhesive (6) is only applied to web regions (11) and the bonding is only carried out on inner surfaces of the web regions (11), further comprising an upper metal support (4) having apertures (9) separated by webs (7), and the bonding is only carried out in the region of the webs (7).

5. A ceiling element (1) for a ceiling (D) comprising a plurality of ceiling elements, having a lower metal support (4), which has apertures separated by webs (7), and an active sound insulation layer (5) accommodated in the metal support (4), and the active sound insulation layer (5) being bonded to the metal support (4), wherein adhesive (6) is only applied to web regions (11) and the bonding is only carried out on inner surfaces of the web regions (11), wherein the lower metal support (4) and an upper metal support (4) are made of expanded metal.

6. A ceiling element (1) for a ceiling (D) comprising a plurality of ceiling elements, having a lower metal support (4), which has apertures separated by webs (7), and an active sound insulation layer (5) accommodated in the metal support (4), and the active sound insulation layer (5) being bonded to the metal support (4), wherein adhesive (6) is only applied to web regions (11) and the bonding is only carried out on inner surfaces of the web regions (11), wherein the lower metal support (4) and an upper metal support (4) are only connected by the active sound layer (5).

7. A ceiling element (1) for a ceiling (D) comprising a plurality of ceiling elements, having a lower metal support (4), which has apertures separated by webs (7), and an active sound insulation layer (5) accommodated in the metal support (4), and the active sound insulation layer (5) being bonded to the metal support (4), wherein adhesive (6) is only applied to web regions (11) and the bonding is only carried out on inner surfaces of the web regions (11), wherein an upper metal support (4) is provided, and the active sound insulation layer (5) is bonded thereto, wherein the lower metal support (4) and the upper metal support (4) also have, in comparison with surface extent, an angled border region (14) running at an angle of 30 to 450 with respect to said surface extent.

8. A ceiling element according to claim 7, wherein an angled portion of the angled border region (14) runs toward the active sound layer (5).

9. A ceiling element according to claim 7, wherein the angled border region (14) merges at its border edge into a flattened portion (16).

10. A ceiling element according to claim 7, wherein the active sound layer (5) is carried through into the angled border region (14) in a continuous manner.

11. A ceiling element according to claim 7, wherein the angled border region (14) is formed after the active sound layer (5) is bonded to the metal support.

12. A ceiling element (1) for a ceiling (D) comprising a plurality of ceiling elements, comprising a lower metal support (4) which has apertures (9) separated by webs (7), and an active sound insulation layer (5) accommodated in the lower metal support (4), and further comprising an upper metal support (4), wherein the upper metal support (4) is connected at its border region by a connection to the lower metal support (4), and the connection is hinge-like at one border region and is positively-locking at an opposite side.

13. A ceiling element according to claim 12, wherein the upper metal support (4) has apertures (9) separated by webs (7).

14. A ceiling element according to claim 12, wherein the upper metal support (4) and the lower metal support (4) are connected directly.

15. A ceiling element according to claim 12, wherein the upper metal support (4) is made of expanded metal.

16. A ceiling element according to claim 12 wherein the upper metal support (4) has protruding fixing sections (19).

17. A ceiling element according to claim 16, wherein the fixing sections (19) are formed integrally on opposite border regions (14).

18. A ceiling element according to claim 16, wherein one of said fixing sections (19) is formed in a vertical projection with the lower metal support (4).

19. A ceiling element according to claim 16, wherein one of said fixing sections (19) is formed outside a vertical projection of the lower metal support (4).

20. A ceiling element according to claim 16, wherein offset dimension (x) of one of said fixing sections (19) corresponds to a projecting dimension (y) of another of said fixing sections (19) of an adjacent of said ceiling element (1).

21. A ceiling element according to claim 16, wherein a lifting clearance is formed within a vertical projection of the lower metal support (4) below one of the fixing sections (19), the lifting clearance (23) serving for angling out a ceiling element (1) from the ceiling (D).

22. A ceiling element according to claim 16, wherein the fixing sections (19) are strengthened by having a double-layered structure.

23. A ceiling element according to claim 22, wherein the double-layered structure comprises a folding under of a border region of the upper metal support.

24. A ceiling element according to claim 12, wherein on mutually opposite border regions of said upper metal support (4), fixing sections (19) are formed in vertical projections respectively with a border region, and outside of an opposite border region of the lower metal support (4).

25. A ceiling element (1) for a ceiling (D) comprising a plurality of ceiling elements, comprising a lower metal support (4) which has apertures (9) separated by webs (7), and an active sound insulation layer (5) accommodated in the lower metal support (4), and further comprising an upper metal support (4), wherein the upper metal support (4) has protruding fixing sections (19), wherein a lifting clearance is formed within a vertical projection of the lower metal support (4) below one of the fixing sections (19), the lifting clearance (23) serving for angling out a ceiling element (1) from the ceiling (D), and the lifting clearance (23) corresponds in vertical direction approximately to half the thickness dimension of an active sound layer (5).

26. A ceiling element (1) for a ceiling (D) comprising a plurality of ceiling elements, having a lower metal support (4), which has apertures separated by webs (7), and an active sound absorption layer (5) accommodated in the metal support (4), and the active sound absorption layer (5) being bonded to the metal support (4), wherein adhesive (6) is only applied to web regions (11), the bonding is only carried out on inner surfaces of the web regions (11), and the bonding is strengthened at web intersections.

27. A ceiling element according to claim 26, wherein the sound layer comprises open-pore foam.

* * * * *